US005183732A

United States Patent [19]

Maskasky

[11] Patent Number: 5,183,732

[45] Date of Patent: Feb. 2, 1993

[54] PROCESS FOR THE PREPARATION OF HIGH CHLORIDE TABULAR GRAIN EMULSIONS (V)

[75] Inventor: Joe E. Maskasky, Rochester, N.Y.

[73] Assignee: Eastman Kodak Company, Rochester, N.Y.

[21] Appl. No.: 820,168

[22] Filed: Jan. 13, 1992

Related U.S. Application Data

[63] Continuation-in-part of Ser. No. 763,382, Sep. 20, 1991, abandoned.

[51] Int. Cl.[5] ..... G03C 1/035; G03C 1/07

[52] U.S. Cl. ..... 430/569; 430/567; 430/615

[58] Field of Search ..... 430/569, 600, 614, 615, 430/567

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,414,306 | 11/1983 | Wey et al. | 430/434 |
| 4,713,323 | 12/1987 | Maskasky | 430/569 |
| 4,783,398 | 11/1988 | Takada et al. | 430/567 |
| 4,804,621 | 2/1989 | Tufano et al. | 430/567 |
| 4,942,120 | 7/1990 | King et al. | 430/567 |
| 4,952,491 | 8/1990 | Nishikawa et al. | 430/570 |
| 4,983,508 | 1/1991 | Ishiguro et al. | 430/569 |

FOREIGN PATENT DOCUMENTS 3-116133 5/1991 Japan .

*Primary Examiner*—Charles L. Bowers, Jr.
*Assistant Examiner*—Mark F. Huff
*Attorney, Agent, or Firm*—Carl O. Thomas

[57] ABSTRACT

A process of preparing a radiation sensitive high chloride high aspect ratio tabular grain emulsion is disclosed wherein silver ion is introduced into a gelatino-peptizer dispersing medium containing a stoichiometric excess of chloride ions with respect to the silver ions further characterized by a chloride ion concentration of less than 0.5 molar, a pH of at least 4.6, and a grain growth modifier of the formula:

where $N^4$ is an amino moiety and

Z represents the atoms completing a 5 or 6 member ring.

17 Claims, 3 Drawing Sheets

0.5 μm

PROCESS FOR THE PREPARATION OF HIGH CHLORIDE TABULAR GRAIN EMULSIONS (V)

This is a continuation-in-part of U.S. Ser. No. 763,382, filed Sep. 20, 1991, now abandoned.

FIELD OF THE INVENTION

The invention relates to the precipitation of radiation sensitive silver halide emulsions useful in photography.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. Although known and used for many years for selected photographic applications, the more rapid developability and the ecological advantages of high chloride emulsions have provided an impetus for employing these emulsions over a broader range of photographic applications. As employed herein the term "high chloride emulsion" refers to a silver halide emulsion containing at least 50 mole percent chloride and less than 5 mole percent iodide, based on total silver.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected tabular grain populations in photographic emulsions.

The various photographic advantages were associated with achieving high aspect ratio tabular grain emulsions. As herein employed and as normally employed in the art, the term "high aspect ratio tabular grain emulsion" has been defined as a photographic emulsion in which tabular grains having a thickness of less than 0.3 μm and an average aspect ratio of greater than 8:1 account for at least 50 percent of the total grain projected area of emulsion. Aspect ratio is the ratio of tabular grain effective circular diameter (ECD), divided by tabular grain thickness (t).

Although the art has succeeded in preparing high chloride tabular grain emulsions, the inclusion of high levels of chloride as opposed to bromide, alone or in combination with iodide, has been difficult. The basic reason is that tabular grains are produced by incorporating parallel twin planes in grains grown under conditions favoring {111} crystal faces. The most prominent feature of tabular grains are their parallel {111} major crystal faces.

To produce successfully a high chloride tabular grain emulsion two obstacles must be overcome. First, conditions must be found that incorporate parallel twin planes into the grains. Second, the strong propensity of silver chloride to produce {100} crystal faces must be overcome by finding conditions that favor the formation of {111} crystal faces.

Wey U.S. Pat. No. 4,399,215 produced the first silver chloride high aspect ratio (ECD/t>8) tabular grain emulsion. An ammoniacal double-jet precipitation technique was employed. The tabularity of the emulsions was not high compared to contemporaneous silver bromide and bromoiodide tabular grain emulsions because the ammonia thickened the tabular grains. A further disadvantage was that significant reductions in tabularity occurred when bromide and/or iodide ions were included in the tabular grains.

Wey et al U.S. Pat. No. 4,414,306 developed a process for preparing silver chlorobromide emulsions containing up to 40 mole percent chloride based on total silver. This process of preparation has not been successfully extended to high chloride emulsions.

Maskasky U.S. Pat. No. 4,400,463 (hereinafter designated Maskasky I) developed a strategy for preparing a high chloride, high aspect ratio tabular grain emulsion capable of tolerating significant inclusions of the other halides. The strategy was to use a particularly selected synthetic polymeric peptizer in combination with a grain growth modifier having as its function to promote the formation of {111} crystal faces. Adsorbed aminoazaindenes, preferably adenine, and iodide ions were disclosed to be useful grain growth modifiers. The principal disadvantage of this approach has been the necessity of employing a synthetic peptizer as opposed to the gelatino-peptizers almost universally employed in photographic emulsions.

This work has stimulated further investigations of grain growth modifiers for preparing tabular grain high chloride emulsions, as illustrated by Takada et al U.S. Pat. No. 4,783,398, which employs heterocycles containing a divalent sulfur ring atom; Nishikawa et al U.S. Pat. No. 4,952,491, which employs spectral sensitizing dyes and divalent sulfur atom containing heterocycles and acyclic compounds; and Ishiguro et al U.S. Pat. No. 4,983,508, which employs organic bis-quaternary amine salts.

Maskasky U.S. Pat. No. 4,713,323 (hereinafter designated Maskasky II), continuing to use aminoazaindene growth modifiers, particularly adenine, discovered that tabular grain high chloride emulsions could be prepared by running silver salt into a dispersing medium containing at least a 0.5 molar concentration of chloride ion and an oxidized gelatino-peptizer. An oxidized gelatino-peptizer is a gelatino-peptizer treated with a strong oxidizing agent to modify by oxidation (and eliminate or reduce as such) the methionine content of the peptizer. Maskasky II taught to reduce the methionine content of the peptizer to a level of less than 30 micromoles per gram. King et al U.S. Pat. No. 4,942,120 is essentially cumulative, differing only in that methionine was modified by alkylation.

While Maskasky II overcame the synthetic peptizer disadvantage of Maskasky I, the requirement of a chloride ion concentration of at least 0.5 molar in the dispersing medium during precipitation presents disadvantages. At the elevated temperatures typically employed for emulsion precipitations using gelatino-peptizers, the high chloride ion concentrations corrode the stainless steel vessels used for the preparation of photographic emulsions. Additionally, the high chloride ion concentrations increase the amount of emulsion washing required after precipitation, and disposal of the increased levels of chloride ion represents increased consumption of materials and an increased ecological burden.

Tufano et al U.S. Pat. No. 4,804,621 disclosed a process for preparing high aspect ratio tabular grain high chloride emulsions in a gelatino-peptizer. Tufano et al observed that over a wide range of chloride ion concentrations ranging from pCl 0 to 3 (1 to $1\times10^{-3}$ M) and a wide range of pH levels, ranging from 2.5 to 9, selected 4,6-diaminopyrimidines were capable of promoting the formation of tabular grains. Tufano et al specifically investigated the use of a 4,6-di(hydroamino)-5-aminopyrimidine (specifically, adenine), but failed to obtain tabular grains using these compounds and explicitly excluded the possibility of having an amino substituent present in the 5-position on the pyrimidine ring.

Japanese patent application No. 03/116,133, published May 17, 1991, discloses a method of manufacturing photographic silver halide emulsions comprising silver chloride grains or silver chlorobromide grains containing at least 80 mole percent chloride. At least 50 percent of the total projected area of the silver chloride or chlorobromide grains is accounted for by tabular grains with a thickness of less than 0.5 μm, a diameter of not less than 0.5 μm, and an aspect ratio of not less than 2:1. The method of manufacturing the emulsion is characterized in that the silver chloride or chlorobromide grains are prepared by the reaction of silver and halide salts in an aqueous solution in the pH range of from 4.5 to 8.5 and in the presence of adenine.

RELATED PATENT APPLICATIONS

Maskasky U.S. Ser. No. 762,971, filed Sep. 20, 1991, and commonly assigned, titled IMPROVED PROCESS FOR THE PREPARATION OF HIGH CHLORIDE TABULAR GRAIN EMULSIONS (II), (hereinafter designated Maskasky III) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

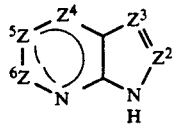

where $Z^2$ is —C($R^2$)=or—N=;

$Z^3$ is —C($R^3$)=or—N=;

$Z^4$ is —C($R^4$)=or—N=;

$Z^5$ is —C($R^5$)=or—N=;

$Z^6$ is —C($R^6$)=or—N=;

with the proviso that no more than one of $Z^4$, $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and $R^6$ is H or $NH_2$.

Maskasky and Chang U.S. Ser. No. 763,013, filed Sep. 20, 1991, concurrently filed and commonly assigned, titled IMPROVED PROCESS FOR THE PREPARATION OF HIGH CHLORIDE TABULAR GRAIN EMULSIONS (III), (hereinafter designated Maskasky et al) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

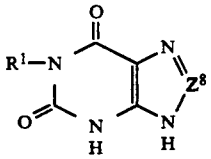

where $Z^8$ is —C($R^8$)=or—N=;

$R^8$ is H, $NH_2$ or $CH_3$; and $R^1$ is hydrogen or a hydrocarbon containing from 1 to 7 carbon atoms.

Maskasky U.S. Ser. No. 763,030, filed Sep. 20, 1991, and commonly assigned, titled ULTRATHIN HIGH CHLORIDE TABULAR GRAIN EMULSIONS, (hereinafter designated Maskasky IV) discloses a high chloride tabular grain emulsion in which greater than 50 percent of the total grain projected area is accounted for by ultrathin tabular grains having a thickness of less than 360 {111} crystal lattice planes. A {111} crystal face stabilizer is adsorbed to the major faces of the ultrathin tabular grains.

SUMMARY OF THE INVENTION

In one aspect, this invention is directed to a process of preparing a radiation sensitive high aspect ratio tabular grain emulsion, wherein tabular grains of less than 0.3 μm in thickness and an average aspect ratio of greater than 8:1 account for greater than 50 percent of the total grain projected area, the tabular grains containing at least 50 mole percent chloride, based on silver, comprising introducing silver ion into a gelatino-peptizer dispersing medium containing a stoichiometric excess of chloride ions at a chloride ion concentration with respect to the silver ions further characterized by less than 0.5 molar, a pH of at least 4.6, and a grain growth modifier of the formula:

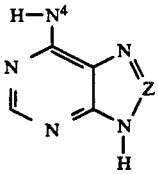

where $N^4$ is an amino moiety and

Z represents the atoms completing a 5 or 6 member ring.

It has been discovered quite unexpectedly that by properly selecting the stoichiometric excess of chloride ion and the pH present in a gelatino-peptizer dispersing medium during precipitation of a high chloride silver halide emulsion a high aspect ratio tabular grain emulsion can be produced by including in the dispersing medium a grain growth modifier satisfying the formula of the preceding paragraph. The practical significance of being able to employ a formula grain growth modifier is that this includes adenine (a.k.a. Vitamin $B^4$), which offers the advantage of ready availability. The lowered stoichiometric excess of chloride ion avoids the corrosion, increased washing, materials consumption and ecological burden concerns inherent in the Maskasky II process. The disadvantage of Maskasky I of requiring a synthetic peptizer is also avoided. Thus, a novel process is provided by this invention which offers a more attractive route to providing a high chloride high aspect ratio tabular grain emulsion.

BRIEF DESCRIPTION OF THE DRAWINGS

FIGS. 1 and 2 are carbon replica electron photomicrographs, with

FIG. 1 showing an emulsion prepared according to the invention in the presence of adenine and FIG. 2 showing an emulsion prepared by a control precipitation procedure.

DESCRIPTION OF PREFERRED EMBODIMENTS

Figure 1:
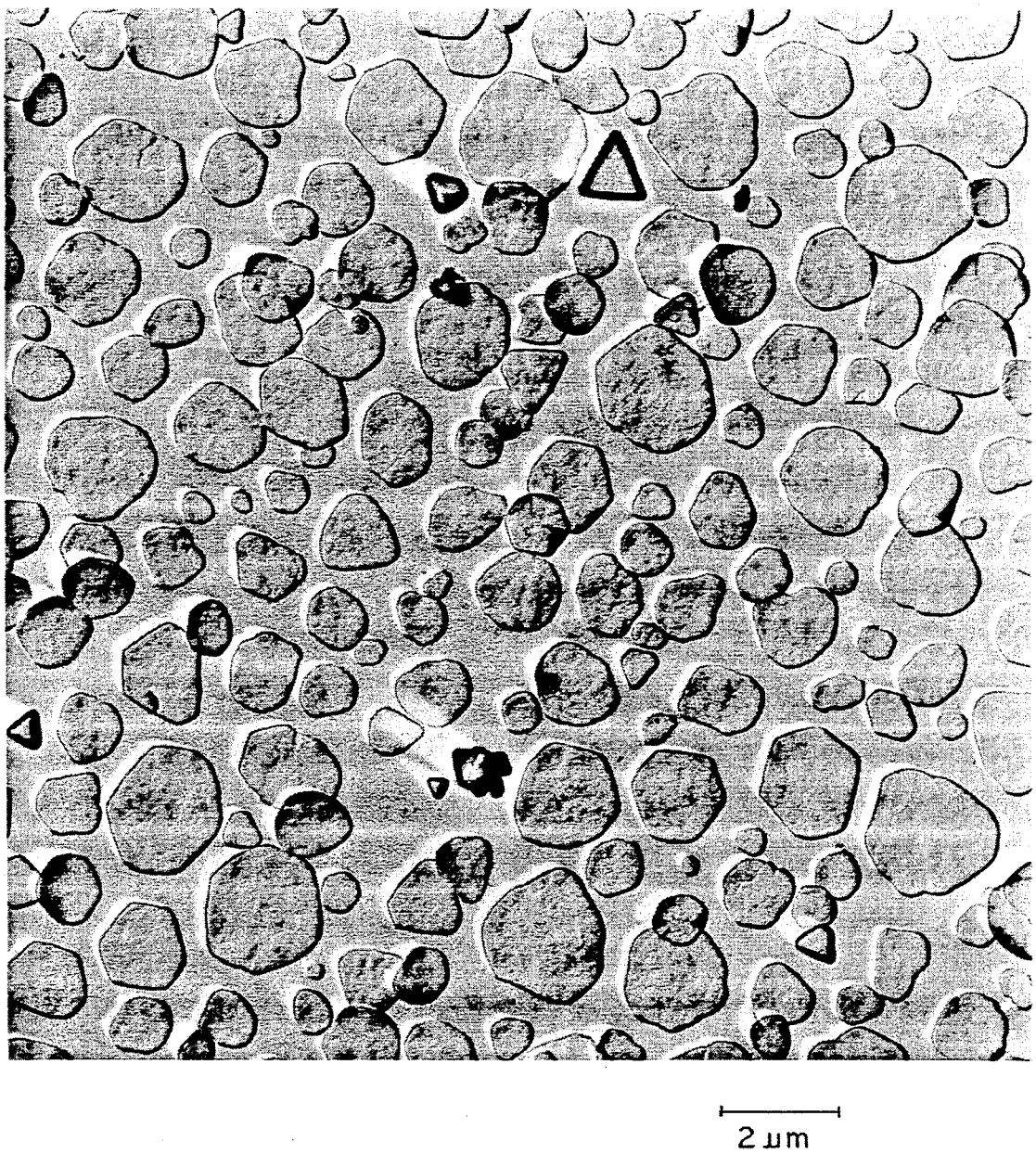

The present invention is directed to an improved process of preparing a high chloride high aspect ratio tabular grain emulsion.

An aqueous gelatino-peptizer dispersing medium is present during precipitation. Gelatino-peptizers include gelatin—e.g., alkali-treated gelatin (cattle bone and hide gelatin) or acid-treated gelatin (pigskin gelatin) and gelatin derivatives—e.g., acetylated gelatin, phthalated gelatin, and the like.

The process of the invention is not restricted to use with gelatino-peptizers of any particular methionine content. That is, gelatino-peptizers with all naturally occurring methionine levels are useful. It is, of course, possible, though not required, to reduce or eliminate methionine, as taught by Maskasky II or King et al, both cited above and here incorporated by reference.

During the precipitation of photographic silver halide emulsions there is always a slight stoichiometric excess of halide ion present. This avoids the possibility of excess silver ion being reduced to metallic silver and resulting in photographic fog. It is a significant advantage of this invention that the stoichiometric excess of chloride ion in the dispersing medium can be maintained at a chloride ion concentration level of less than 0.5M while still obtaining a high aspect ratio tabular grain emulsion. It is generally preferred that the chloride ion concentration in the dispersing medium be less than 0.2M and, optimally, equal to or less than 0.1M.

The advantages of limiting the stoichiometric excess of chloride ion present in the reaction vessel during precipitation include (a) reduction of corrosion of the equipment (the reaction vessel, the stirring mechanism, the feed jets, etc.), (b) reduced consumption of chloride ion, (c) reduced washing of the emulsion after preparation, and (d) reduced chloride ion in effluent. It has also been observed that reduction in the chloride ion excess contributes to obtaining thinner tabular grains.

The pH of the dispersing medium is maintained at a level of at least 4.6. Whereas the Examples of Maskasky I report relevant halide compositions having pH values of 2.6 and 3.0, the Examples of Maskasky II report a pH of 4.0 and Tufano et al report a pH of 4.0 for the adenine control, it has been discovered that, for adenine and the related grain growth modifiers of this invention to be effective growth modifiers in gelatino-peptizers with a limited stoichiometric excess of chloride ion present, the pH must have a value of at least 4.6. The maximum pH contemplated during precipitation can range up to 9. It is generally preferred to conduct precipitation in the pH range of from 5.0 to 8.0. A strong mineral acid, such as nitric acid or sulfuric acid, or a strong mineral base, such as an alkali hydroxide, can be employed to adjust the pH within a selected range. When a basic pH is to be maintained, it is preferred not to employ ammonium hydroxide, since it has the unwanted effect of acting as a ripening agent and is known to thicken tabular grains. However, to the extent that thickening of the tabular grains does not exceed the 0.3 μm thickness limit, ammonium hydroxide or other conventional ripening agents (e.g., thioether or thiocyanate ripening agents) can be present within the dispersing medium.

Any convenient conventional approach of monitoring and maintaining replicable pH profiles during repeated precipitations can be employed (e.g., refer to *Research Disclosure* Item 308,119, cited below). Maintaining a pH buffer in the dispersing medium during precipitation arrests pH fluctuations and facilitates maintenance of pH within selected limited ranges. Exemplary useful buffers for maintaining relatively narrow pH limits within the ranges noted above include sodium or potassium acetate, phosphate, oxalate and phthalate as well as tris (hydroxymethyl)-aminomethane.

In addition to the precipitation criteria noted above, it is contemplated to have present a grain growth modifier satisfying the formula:

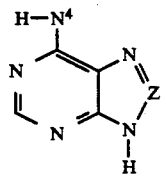

(I)

where $N^4$ is an amino moiety and

Z represents the atoms completing a 5 or 6 member ring.

All references to "formula" grain growth modifiers are intended to designate grain growth modifiers satisfying formula I, unless otherwise stated.

$N^4$ can take the form of any synthetically convenient primary or secondary group. In the simplest contemplated form $N^4$ is a primary amino group (—$NH_2$). In an alternative preferred form $N^4$ is a secondary amino group (—NHR), where the substituent R is a hydrocarbon containing from 1 to 7 carbon atoms. R is preferably an alkyl group—e.g., methyl, ethyl, n-propyl, i-propyl, n-butyl, i-butyl, t-butyl, etc., although other hydrocarbons, such as cyclohexyl or benzyl, are contemplated. To increase growth modifier solubility the hydrocarbon group can, in turn, be substituted with polar groups, such as hydroxy, sulfonyl or amino groups, if desired, or the hydrocarbon can be substituted with other groups that do not materially affect their properties (e.g., a halo substituent.

Z is chosen to complete a five or six member ring fused with the pyrimidine ring. Specifically contemplated five and six member fused rings include imidazolo, triazolo, and pyrazino rings.

In one specifically preferred form of the invention the grain growth modifier satisfies the following formula:

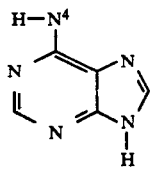

(II)

where $N^4$ is as previously defined. When the H-$N^4$-substituent is a primary amino group (i.e., $H_2N$- ), the resulting compound is adenine:

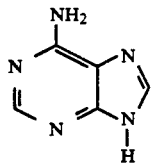

(III)

The following are illustrations of formula grain growth modifiers within the purview of the invention:

Adenine

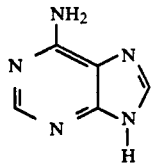

PY-1

6-(N-Methylamino)purine

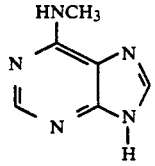

PY-2

6-(N-Ethylamino)purine

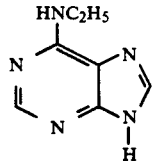

PY-3

6-(N-Butylamino)purine

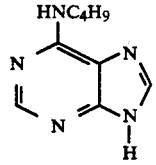

PY-4

4-Amino-7,8-dihydropteridine

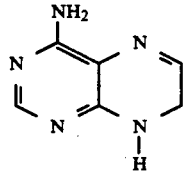

PY-5

8-Azaadenine

-continued

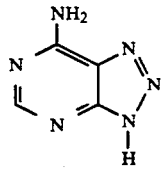

PY-6

6-Benzylaminopurine $C_6H_6CH_2NH_2$

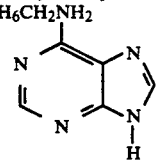

PY-7

In forming high chloride high aspect ratio tabular grain emulsions, tabular grains containing at least 50 mole percent chloride, based on silver, and having a thickness of less than 0.3 μm must account for greater than 50 percent of the total grain projected area. In preferred emulsions the tabular grains having a thickness of less than 0.2 μm account for at least 70 percent of the total grain projected area and, optimally, at least 90 percent of the total grain projected area.

For tabular grains to satisfy the projected area requirement it is necessary first to induce twinning in the grains as they are being formed, since only grains having two or more parallel twin planes will assume a tabular form. Second, after twinning has occurred, it is necessary to restrain precipitation onto the major {111} crystal faces of the tabular grains, since this has the effect of thickening the grains. The formula grain growth modifiers employed in the practice of this invention are effective during precipitation to produce an emulsion satisfying both the tabular grain thickness and projected area parameters noted above.

It is generally recognized that introducing twin planes in the grains at a very early stage in their formation offers the capability of producing thinner tabular grains than can be achieved when twinning is delayed. For this reason it is usually preferred that the conditions within the dispersing medium prior to silver ion introduction at the outset of precipitation be chosen to favor twin plane formation. To facilitate twin plane formation it is contemplated to incorporate the formula grain growth modifier in the dispersing medium prior to silver ion addition in a concentration of at least $2\times10^{-4}$M, preferably at least $5\times10^{-4}$M, and optimally at least $7\times10^{-4}$M. Generally little increase in twinning can be attributed to increasing the initial grain growth modifier concentration in the dispersing medium above 0.01M. Higher initial grain growth modifier concentrations up to 0.05M, 0.1M or higher are not incompatible with the twinning function. The maximum growth modifier concentration in the dispersing medium is often limited by its solubility. It is contemplated to introduce into the dispersing medium growth modifier in excess of that which can be initially dissolved. Any undissolved growth modifier can provide a source of additional growth modifier solute during precipitation, thereby stabilizing growth modifier concentrations within the ranges noted above. It is preferred to avoid quantities of grain growth modifier in excess of those observed to control favorably tabular grain parameters.

Once a stable multiply twinned grain population has been formed within the dispersing medium, the primary, if not exclusive, function the grain growth modifier is called upon to perform is to restrain precipitation onto the major {111} crystal faces of the tabular grains, thereby retarding thickness growth of the tabular grains. In a well controlled tabular grain emulsion precipitation, once a stable population of multiply twinned grains has been produced, tabular grain thicknesses can be held essentially constant.

The amount of grain growth modifier required to control thickness growth of the tabular grain population is a function of the total grain surface area. Adenine has been long recognized to adsorb to {111} silver halide grain surfaces. By adsorption onto the {111} surfaces of the tabular grains the formula grain growth modifier restrains precipitation onto the grain faces and shifts further growth of the tabular grains to their edges.

The benefits of this invention can be realized using any amount of grain growth modifier that is effective to retard thickness growth of the tabular grains. It is generally contemplated to have present in the emulsion during tabular grain growth sufficient grain growth modifier to provide a monomolecular adsorbed layer over at least 25 percent, preferably at least 50 percent, of the total {111} grain surface area of the emulsion grains. Higher amounts of adsorbed grain growth modifier are, of course, feasible. Adsorbed grain growth modifier coverages of 80 percent of monomolecular layer coverage or even 100 percent are contemplated. In terms of tabular grain thickness control there is no significant advantage to be gained by increasing grain growth modifier coverages above these levels. Any excess grain growth modifier that remains unadsorbed is normally depleted in post-precipitation emulsion washing.

Prior to introducing silver salt into the dispersing medium at the outset of the precipitation process, no grains are present in the dispersing medium and the initial grain growth modifier concentrations in the dispersing medium are therefore more than adequate to provide the monomolecular coverage levels noted above as grains are initially formed. As tabular grain growth progresses it is a simple matter to add grain growth modifier, as needed, to maintain monomolecular coverages at desired levels, based on knowledge of amount of silver ion added and the geometrical forms of the grains being grown.

The formula grain growth modifiers described above are capable of use during precipitation as the sole grain growth modifier. That is, these grain growth modifiers are capable of influencing both twinning and tabular grain growth to provide high chloride high aspect ratio tabular grain emulsions.

It has been discovered that improvements in precipitation can be realized by employing a combination of grain growth modifiers in which the more tightly adsorbed of the grain growth modifiers is employed for tabular grain thickness growth reduction and the less tightly adsorbed of the grain growth modifiers is employed for twinning. Specifically, it has been observed that formula grain growth modifiers produce improved emulsions when added to the reaction vessel after twinning in the presence of a less tightly absorbed grain growth modifier.

For example, it is contemplated to add a formula grain growth after twinning in the presence of a 4,5,6-triaminopyrimidine satisfying the following formula:

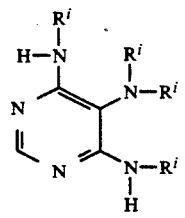

(IV)

where $R^i$ is independently in each occurrence hydrogen or alkyl of from 1 to 6 carbon atoms.

Alternatively, the grain growth modifier of formula IV can be replaced by a grain growth modifier of the following structure:

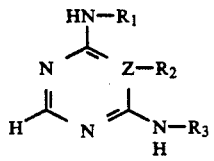

(V)

wherein Z is C or N; $R_1$, $R_2$ and $R_3$, which may be the same or different, are H or alkyl of 1 to 5 carbon atoms; when Z is C, $R_2$ and $R_3$ when taken together can be $—CR_4{=}CR_5—$ or $—CR_4{=}N—$, wherein $R_4$ and $R_5$, which may be the same or different are H or alkyl of 1 to 5 carbon atoms, with the proviso that when $R_2$ and $R_3$ taken together form the $—CR_4{=}N—$ linkage, $—CR_4{=}$ must be joined to Z. Grain growth modifiers of this type and conditions for their use are disclosed by Tufano et al, cited above, the disclosure of which is here incorporated by reference.

It is also contemplated to employ during grain twinning or growth a grain growth modifier of the type disclosed by Maskasky III, cited above. These grain growth modifiers are effective when the dispersing medium is maintained at a pH in the range of from 3 to 9 (preferably 4.5 to 8) and contains a stoichiometric excess of chloride ions of less than 0.5 molar. These grain growth modifiers satisfy the formula:

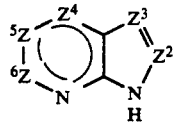

(VI)

where $Z^2$ is $—C(R^2){=}$ or $—N{=}$;
$Z^3$ is $—C(R^3){=}$ or $—N{=}$;
$Z^4$ is $—C(R^4){=}$ or $—N{=}$;
$Z^5$ is $—C(R^5){=}$ or $—N{=}$;
$Z^6$ is $—C(R^6){=}$ or $—N{=}$;
with the proviso that no more than one of $Z^4$, $Z^5$ and $Z^6$ is $—N{=}$;
$R^2$ is H, $NH_2$ or $CH_3$;
$R^3$, $R^4$ and $R^5$ are independently selected, $R^3$ and R5 being hydrogen, hydroxy, halogen, amino or hydrocarbon and $R^4$ being hydrogen, halogen or hydrocarbon, each hydrocarbon moiety containing from 1 to 7 carbon atoms; and
$R^6$ is H or $NH_2$.

Another class of grain growth modifier useful during grain twinning or growth under similar conditions as the grain growth modifiers of formula VI are the xanthine type grain growth modifiers of Maskasky et al, cited above. These grain growth modifiers are represented by the formula:

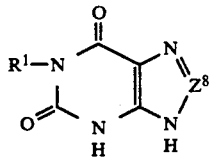

(VII)

where $Z^8$ is —C($R^8$)= or —N=;

$R^8$ is H, $NH_2$ or $CH_3$; and $R^1$ is hydrogen or a hydrocarbon containing from 1 to 7 carbon atoms.

Still another type of grain growth modifier contemplated for use during grain growth is iodide ion. The use of iodide ion as a grain growth modifier is taught by Maskasky I, the disclosure of which is here incorporated by reference.

In Maskasky U.S. Pat. No. 4,061,617 (hereinafter referred to as Maskasky VI) it is taught to maintain a concentration of thiocyanate ions in the dispersing medium of from 0.2 to 10 mole percent, based on total silver introduced, to produce a high chloride tabular grain emulsion. It is here contemplated to utilize thiocyanate ion in a similar manner to control tabular grain growth. However, whereas Maskasky VI employs a 0.5M concentration of chloride ion in the dispersing medium, the presence of the formula grain growth modifier in the dispersing medium at the outset of precipitation allows lower chloride ion levels to be present in the dispersing medium, as described above. The thiocyanate ion can be introduced into the dispersing medium as any convenient soluble salt, typically an alkali or alkaline earth thiocyanate salt. When the dispersing medium is acidic (i.e., the pH is less than 7.0) the counter ion of the thiocyanate salt can be ammonium ion, since ammonium ion releases an ammonia ripening agent only under alkaline conditions. Although not preferred, an ammonium counter ion is not precluded under alkaline conditions, since, as noted above, ripening can be tolerated to the extent that the 3 μm thickness limit of the tabular grains is not exceeded.

In addition to or in place of the preferred growth modifiers for use in combination with the formula growth modifiers of this invention it is contemplated to employ other conventional growth modifiers, such any of those disclosed by Takada et al, Nishikawa et al, Ishiguro et al and Tufano et al, cited above and here incorporated by reference. In general thinner tabular grain populations can be realized when the formula grain growth modifier is present during grain twinning with other grain growth modifiers, when employed, being introduced during tabular grain growth following twinning.

Since silver bromide and silver iodide are markedly less soluble than silver chloride, it is appreciated that bromide and/or iodide ions, if introduced into the dispersing medium, are incorporated into the grains in the presence of the chloride ions. The inclusion of bromide ions in even small amounts has been observed to improve the tabularities of the emulsions. Bromide ion concentrations of up to 50 mole percent, based on total silver are contemplated, but to increase the advantages of high chloride concentrations it is preferred to limit the presence of other halides so that chloride accounts for at least 80 mole percent, based on silver, of the completed emulsion. Iodide can be also incorporated into the grains as they are being formed. It is preferred to limit iodide concentrations to 2 mole percent or less based on total silver. Thus, the process of the invention is capable of producing high chloride tabular grain emulsions in which the tabular grains consist essentially of silver chloride, silver bromochloride, silver iodochloride or silver iodobromochloride, where the halides are designated in order of ascending concentrations.

Either single-jet or double-jet precipitation techniques can be employed in the practice of the invention, although the latter is preferred. Grain nucleation can occur before or instantaneously following the addition of silver ion to the dispersing medium. While sustained or periodic subsequent nucleation is possible, to avoid polydispersity and reduction of tabularity, once a stable grain population has been produced in the reaction vessel, it is preferred to precipitate additional silver halide onto the existing grain population.

In one approach silver ion is first introduced into the dispersing medium as an aqueous solution, such as a silver nitrate solution, resulting in instantaneous grain nuclei formation followed immediately by addition of the growth modifier to induce twinning and tabular grain growth. Another approach is to introduce silver ion into the dispersing medium as preformed seed grains, typically as a Lippmann emulsion having an ECD of less than 0.05 μm. A small fraction of the Lippmann grains serve as deposition sites while the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048, the disclosures of which are here incorporated by reference. In still another approach, immediately following silver halide seed grain formation within or introduction into a reaction vessel, a separate step is provided to allow the initially formed grain nuclei to ripen. During the ripening step the proportion of untwinned grains can be reduced, thereby increasing the tabular grain content of the final emulsion. Also, the thickness and diameter dispersities of the final tabular grain population can be reduced by the ripening step. Ripening can be performed by stopping the flow of reactants while maintaining initial conditions within the reaction vessel or increasing the ripening rate by adjusting pH, the chloride ion concentration, and/or increasing the temperature of the dispersing medium. The pH, chloride ion concentration and grain growth modifier selections described above for precipitation can be first satisfied from the outset of silver ion precipitation or during the ripening step.

Except for the distinguishing features discussed above, precipitation according to the invention can take any convenient conventional form, such as disclosed in *Research Disclosure* Vol. 225, Jan. 1983, Item 22534; *Research Disclosure* Vol. 308, Dec. 1989, Item 308,119 (particularly Section I); Maskasky I, cited above; Wey et al, cited above; and Maskasky II, cited above; the disclosures of which are here incorporated by reference. It is typical practice to incorporate from about 20 to 80 percent of the total dispersing medium into the reaction vessel prior to nucleation. At the very outset of nucleation a peptizer is not essential, but it is usually most convenient and practical to place peptizer in the reaction vessel prior to nucleation. Peptizer concentrations of from about 0.2 to 10 (preferably 0.2 to 6) percent, based on the total weight of the contents of the reaction vessel are typical, with additional peptizer and other vehicles typically being added to emulsions after they are prepared to facilitate coating.

Once the nucleation and growth steps have been performed the emulsions can be applied to photographic applications following conventional practices. The emulsions can be used as formed or further modified or blended to satisfy particular photographic aims. It is possible, for example, to practice the process of this invention and then to continue grain growth under conditions that degrade the tabularity of the grains and/or alter their halide content. It is also common practice to blend emulsions once formed with emulsions having differing grain compositions, grain shapes and/or tabular grain thicknesses and/or aspect ratios.

EXAMPLES

The invention can be better appreciated by reference to the following examples.

The mean thickness of tabular grain populations was measured by optical interference for mean thicknesses >0.06 μm (measuring more than 1000 tabular grains), and using edge-on views observed by scanning electron microscopy for samples too thin to measure by the optical interference technique (<0.06 μm) (measuring from 50 to 100 tabular grains).

The terms ECD and t are employed as noted above; r.v. represents reaction vessel; TGPA indicates the percentage of the total grain projected area accounted by tabular grain of less than 0.3 μm thickness.

EXAMPLE 1A

AgCl High Aspect Ratio Tabular Grain Emulsion Made at pH~6.0

This example illustrates that an AgCl high aspect ratio tabular grain emulsion can be prepared using adenine as the growth modifier and a reaction vessel chloride ion concentration of less than 0.5M.

A stirred reaction vessel containing 3L of a solution which was 2% in bone gelatin, 3.5 mM in adenine, 0.070M in NaCl, and 0.20M in sodium acetate was adjusted to pH 6.2 with $HNO_3$ at 75° C. To this solution at 75° C. was added 4M $AgNO_3$ solution at 1 mL/min for 4 min and then the rate of solution was linearly accelerated over an additional period of 60 min (20X from start to finish) and finally held constant at 20 mL/min until 750 mL of solution was consumed. When the pAg reached 6.60 (0.03M in chloride), a 4M NaCl solution was added at a rate needed to maintain this pAg. The final pH was 5.9. A total of 3.0 moles of AgCl was precipitated. The emulsion was cooled to 40° C. and washed by the coagulation method of Yutzy and Russell U.S. Pat. No. 2,614,929.

The resultant high aspect ratio tabular grain AgCl emulsion had an average tabular grain diameter of 1.3 μm, an average tabular grain thickness of 0.078 μm, and an average tabular grain aspect ratio of 17:1, and 85% of the grains were tabular based on total grain projected area. A carbon replica electron micrograph of this emulsion is shown in FIG. 1.

CONTROL 1B

AgCl Comparison Emulsion Made at pH=4.5

Figure 2:
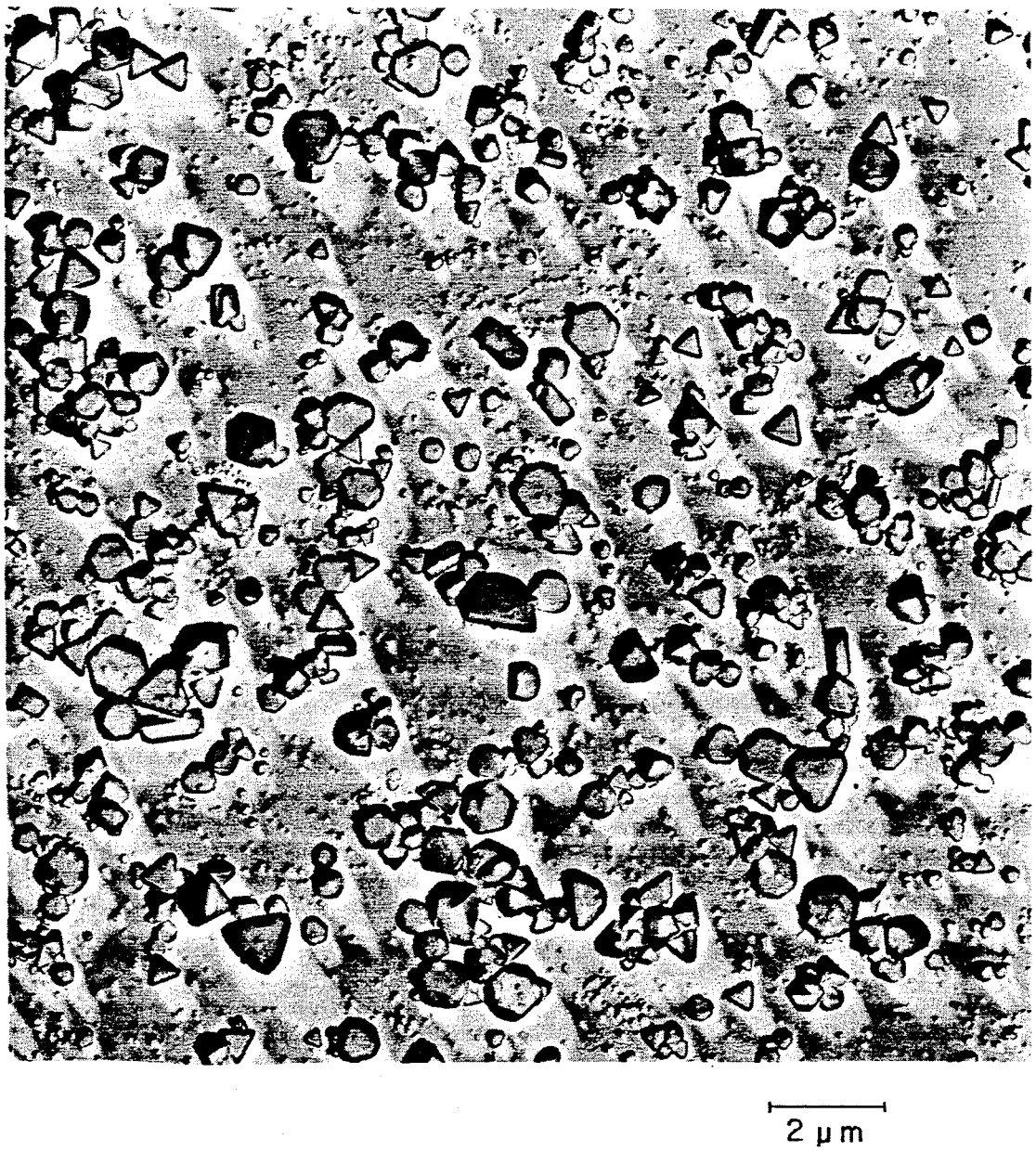

This emulsion was prepared as described in Example 1A except that the pH of the reaction vessel was adjusted to 4.5 at 75° C. with $HNO_3$ and maintained at this value throughout the precipitation. An emulsion consisting of nontabular grains resulted. FIG. 2 shows a carbon replica electron micrograph of this emulsion.

EXAMPLE 2

AgCl High Aspect Ratio Tabular Grain Emulsion

This example illustrates that an AgCl high aspect ratio tabular grain emulsion can be prepared without the need for a pH buffer.

This emulsion was prepared similar to that of Example 1A, except that sodium acetate was not used and the pH was kept constant at 6.2 during the precipitation by the addition of a NaOH solution.

The resultant tabular grain AgCl emulsion had an average tabular grain diameter of 1.1 μm, an average thickness of 0.082 μm, and an average aspect ratio of 13:1, and 75% of the grains were tabular based on total grain projected area.

EXAMPLE 3

AgCl High Aspect Ratio Tabular Grain Emulsion Made at pH~6.0 and Using 2M $AgNO_3$ This example illustrates the preparation of AgCl tabular grains using 2M $AgNO_3$ and 2M NaCl solutions.

This example was prepared similar to that of Example 1A, except that 2M $AgNO_3$ and NaCl solutions were used. The flow rate of the $AgNO_3$ solution was accelerated as in Example 1 until 18 mL/min was achieved and then held constant at this rate until 1.5L was used. It took 117 min to precipitate the 3.0 moles of AgCl. The final pH was 5.9.

The resultant AgCl high aspect ratio tabular grain emulsion had an average tabular grain diameter of 2.0 μm, and an average tabular grain thickness of 0.084 μm, an average aspect ratio of 24:1, and 90% of the grains were tabular based on total grain projected area.

EXAMPLES 4A, 4B, and 4C

AgCl Tabular Grain High Aspect Ratio Emulsions Made Using a Reduced Adenine Concentration in the Reaction Vessel These examples illustrate the ability to control tabular grain thickness by selection of the adenine concentration in the reaction vessel relative to the amount of silver chloride precipitated.

These examples were prepared similar to that of Example 1A, except that the initial solution in the reaction vessel was 1.5 mM in adenine and the accelerated flow rate was stopped when the desired amount of $AgNO_3$ had been added. The results are summarized in Table I.

TABLE I

| | | mmoles | Tabular Grain Population | | | |
|---|---|---|---|---|---|---|
| Example | Moles $AgNO_3$ Added | Adenine per Ag Mole | Mean ECD μm | Mean t μm | Mean Aspect Ratio | % TPGA |
| 4A | 1 | 4.5 | 1.0 | 0.089 | 11:1 | 75 |
| 4B | 2 | 3.0 | 1.2 | 0.104 | 12:1 | 75 |

TABLE I-continued

| Example | Moles $AgNO_3$ Added | mmoles Adenine per Ag Mole | Tabular Grain Population Mean ECD μm | Mean t μm | Mean Aspect Ratio | % TPGA |
|---|---|---|---|---|---|---|
| 4C | 3 | 1.5 | 1.3 | 0.155 | 8.4:1 | 75 |

The tabular grain thickness increases as more silver chloride is precipitated at this fixed initial adenine concentration. Also, at final lower adenine to silver ratios, the tabular grains had better defined projected shapes (i.e., hexagons and triangles).

EXAMPLE 5A

AgBrCl (10 Mole % Br) High Aspect Ratio Tabular Grain Emulsion

This emulsion was prepared as described for Example 1A, except that 0.0075 mole NaBr was added initially to the reaction vessel solution, and the halide solution was 3.6M in NaCl and 0.4M in NaBr.

The resultant tabular grain AgBrCl emulsion had an average tabular grain diameter of 1.2 μm, an average tabular grain thickness of 0.081 μm, and an average tabular grain aspect ratio of 15:1, and 75% of the grains were tabular based on total grain projected area.

EXAMPLE 6

AgCl High Aspect Ratio Tabular Grain Emulsion Made by Addition of Adenine During the Precipitation, pH~6.0

This example illustrates that AgCl high aspect ratio tabular grain emulsion can be prepared by placing a portion of the adenine in the reaction vessel and adding the remainder during the precipitation. Larger diameter tabular grains were obtained by not adding all of the adenine initially to the reaction vessel.

A stirred reaction vessel containing 3L of a solution which was 2% in bone gelatin, 1.2 mM in adenine, 0.070M in NaCl, and 0.20M in sodium acetate was adjusted to pH 6.2 with $HNO_3$ at 75° C. To this solution at 75° C. was added 4M $AgNO_3$ solution at 1 mL/min for 4 min and then the rate of addition was linearly accelerated over an additional period of 60 min (20X from start to finish) and finally held constant at 20 mL/min until 750 mL of solution was consumed. When the pAg reached 6.60 (0.03M in chloride), a solution consisting of 4M NaCl and 9.3 mM adenine was added at a rate needed to maintain this pAg. A total of 6.90 mmoles of adenine was added from this solution. The final pH was 5.9. A total of 3.0 moles of AgCl was precipitated and 3.5 mmoles of adenine per mole AgCl were used.

The resultant high aspect ratio tabular grain AgCl emulsion had an average tabular grain diameter of 2.2 μm, an average tabular grain thickness of 0.084 μm, and an average tabular grain aspect ratio of 26:1, and 80% of the grains were tabular based on total grain projected area.

EXAMPLE 7

AgCl Control and High Aspect Ratio Tabular Grain Emulsions Made by Addition of Adenine During the Precipitation These examples and one control illustrate the effect of precipitation pH on the formation and size of tabular grains.

CONTROL 7A pH=4.5

This control emulsion was precipitated similar to Example 6 except the precipitation pH was adjusted to 4.5 and maintained at this value through the precipitation. The grain characteristics are summarized in Table II. Less than 3% of the total grain projected area was accounted for by tabular-like grains with a mean grain thickness of 0.57 μm, mean diameter of 1.7 μm, and average aspect ratio of 3:1. The rest of the emulsion grain population consisted of octahedra and other non-tabular grain shapes. This is not a tabular grain emulsion.

EXAMPLE 7B pH=5.3

This emulsion was prepared similar to that of Example 6, except that the precipitation pH was held constant at 5.3.

The resultant tabular grain AgCl emulsion is summarized in Table II.

EXAMPLE 7C pH=7.0

This emulsion was prepared similar to that of Example 6, except that no sodium acetate was present and the pH was held constant at 7.0. The resultant tabular grain AgCl emulsion is summarized in Table II.

EXAMPLE 7D pH=8.0

This emulsion was prepared similar to that of Example 6, except that no sodium acetate was present and the pH was held constant at 8.0. The resultant tabular grain AgCl emulsion is summarized in Table II.

TABLE II

| Emulsion | Initial Ppt. pH | Tabular Grain Population Mean ECD μm | Mean t μm | Mean Aspect Ratio | % TGPA |
|---|---|---|---|---|---|
| 7A Control | 4.5 | — | — | — | 0 |
| 7B Example | 5.3 | 1.4 | 0.078 | 18:1 | 65 |
| 6 Example | 6.2 | 2.2 | 0.084 | 26:1 | 80 |
| 7C Example | 7.0 | 2.7 | 0.099 | 28:1 | 90 |
| 7D Example | 8.0 | 3.3 | 0.17 | 19:1 | 55 |

EXAMPLE 8

AgCl High Aspect Ratio Tabular Grain Emulsion Made Using Shortened Precipitation Time This example shows that an AgCl high aspect ratio tabular grain emulsion can be made using a shortened precipitation time.

This emulsion was prepared similar to that of Example 6, except that the silver nitrate solution was added at a constant flow rate of 19 mL per min from start to finish. It took 39 min to precipitate 3 moles of AgCl emulsion.

The resultant high aspect ratio tabular grain emulsion consisted of tabular grains with an average diameter of 1.5 μm, an average tabular grain thickness of 0.086 μm, and an average tabular grain aspect ratio of 18:1 and 90% of the grains were tabular based on total grain projected area.

EXAMPLE 9

AgCl High Aspect Ratio Tabular Grain Emulsion Made Using a Reduced Adenine Concentration This example illustrates making an AgCl tabular grain emulsion with 1.5 mmoles adenine per mole AgCl with a portion of this adenine being added during the precipitation.

This emulsion was prepared similar to that of Example 6, except that the adenine concentrations were reduced. The initial solution in the reaction vessel was 0.70 mM in adenine and the pAg was maintained with a solution that was 4M in NaCl and 3.2 mM in adenine. A total of 745 mL of this solution was used to precipitate 3 moles of AgCl.

The resultant AgCl high aspect ratio tabular grain emulsion had an average tabular grain diameter of 2.3 μm, an average thickness of 0.111 μm, and an average tabular grain aspect ratio of 21:1 and 75% of the grains were tabular based on total grain projected area. Most of the tabular grains had a well defined hexagonal shape.

EXAMPLE 10

AgCl High Aspect Ratio Tabular Grain Emulsion Made Using Oxidized Gelatin

This example demonstrates that a gelatino-peptizer low in methionine content can be used to prepare an AgCl high aspect ratio tabular grain emulsion at an excess chloride ion concentration <0.5M.

This emulsion was prepared similar to that of Example 7C, except that the gelatin used in Example 7C, containing 55 μmoles methionine per gram gelatin, was substituted for one that, by oxidation, was reduced to less than 4 μmoles methionine per gram gelatin.

The resultant high aspect ratio tabular grain AgCl emulsion had an average tabular grain diameter of 2.3 μm, an average tabular grain thickness of 0.086 μm. and an average tabular grain aspect ratio of 27:1, and 90% of the grains were tabular based on total grain projected area.

EXAMPLE 11

AgICl (1 mole % I) High Aspect Ratio Tabular Grain Emulsion

A stirred reaction vessel containing 3L of a solution which was 2% in bone gelatin, 1.2 mM in adenine, and 0.070M in NaCl, was adjusted to pH 7.0 at 75° C. To this solution at 75° C. was added 4M $AgNO_3$ solution at 1 mL/min for 4 min and then the rate of solution was linearly accelerated over an additional period of 60 min (20× from start to finish) and finally held constant at 20 mL/min until 750 mL of solution was consumed. When the pAg reached 6.60 (0.03M in chloride), a solution consisting of 3.96M NaCl and 0.04M NaI was added at a rate needed to maintain this pAg. The pH was maintained at 7.0. A total of 30 mmoles of NaI were added. A total of 3.0 moles of AgICl were precipitated.

The resultant tabular grain AgICl emulsion had an average tabular grain diameter of 2.1 μm, an average tabular grain thickness of 0.119 μm, and an average tabular grain aspect ration of 18:1, and 75% of the grains were tabular based on total grain projected area. Greater than 90% of the tabular grains had a well defined hexagonal shape.

EXAMPLES 12–17

Ultrathin High Aspect Ratio Tabular Grains

In these examples, which demonstrate ultra-thin high aspect ratio tabular grains, the mean equivalent circular diameter of the tabular grain population and an estimate of the relative projected area of the tabular grain, fine grain (grains <0.2 mm) and large nontabular grain populations were obtained from optical and scanning electron micrographs. The mean tabular grain thickness was obtained from tabular grain edge-on views at 80,000× magnification of from 50 to 100 randomly selected grains. (Each grain edge was measured at 5 locations to obtain an average thickness. This average thickness was then averaged with those of other grains to obtain the mean tabular grain thickness.)

EXAMPLE 12

AgCl Ultrathin High Aspect Ratio Tabular Grain Emulsions Made Using Accelerated Flow Rate $AgNO_3$ Addition at 75° C. and at 60° C.

EXAMPLE 12A

A stirred reaction vessel containing 400 mL of a solution which was 2% in bone gelatin, 3.6 mM in adenine, 0.030M in NaCl, and 0.20M in sodium acetate was adjusted to pH 6.2 with $HNO_3$ at 75° C. To this solution at 75° C. was added 4m $AgNO_3$ solution at 0.25 mL/min for 1 min and then the rate of solution was linearly accelerated over an additional period of 30 min (20× from start to finish) and finally held constant at 5.0 mL/min until 0.4 mole of $AgNO_3$ was consumed. When the pH reached 6.0, the addition was stopped, and the emulsion was adjusted back to pH 6.2 with NaOH. The pAg was held constant at 6.64 (0.04M in chloride) by adding a solution that was 4M in NaCl and 16 mM in adenine and had a pH of 6.3. The results are summarized in Table III.

EXAMPLE 12B

This emulsion was prepared as described in Example 12A, except that 0.27 mole of $AgNO_3$ was added. The results are summarized in Table III.

EXAMPLE 12C

This emulsion was prepared as described in Example 12A, except that the reaction vessel was 1.8 mM in adenine, the precipitation temperature was 60° C., and 0.27 mole of $AgNO_3$ was added. The results are summarized in Table III.

EXAMPLE 12D

This emulsion was prepared as described in Example 12A, except that the reaction vessel was 1.8 mM in adenine, and the precipitation temperature was 60° C. The results are summarized in Table III.

EXAMPLE 13

AgCl Ultrathin High Aspect Ratio Tabular Grain Emulsions Made Using Constant Flow Rate $AgNO_3$ Addition and Various Reaction Vessel Adenine Concentrations

EXAMPLE 13A

A stirred reaction vessel containing 400 mL of a solution which was 2% in bone gelatin, 3.6 mM in adenine, 0.030M in NaCl, and 0.20M in sodium acetate was adjusted to pH 6.2 with $HNO_3$ at 75° C. To this solution at 75° C. was added 4M $AgNO_3$ solution at 5.0 mL/min. When the pH reached 6.0, the addition was stopped and adjusted to 6.2 with NaOH. The pAg was held constant at 6.64 (0.04M in chloride) by adding a solution that was 4M in NaCl and 16 mM in adenine. The amount of $AgNO_3$ added was 0.27 mole. The results are summarized in Table III.

EXAMPLE 13B

Figure 3:
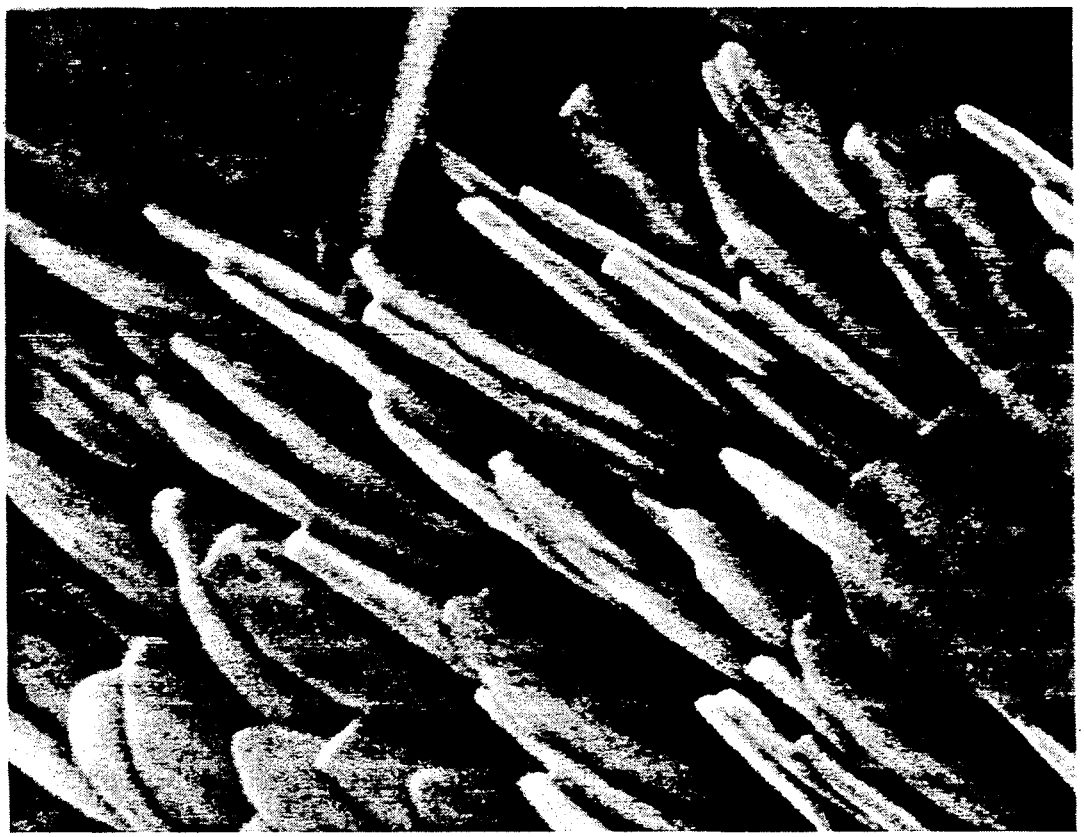
FIG. 3 is a scanning electron photomicrograph of an emulsion prepared according to the invention.

This emulsion was prepared as described in Example 13A, except that the reaction vessel was 1.8 mM in adenine. The results are given in Table III. A scanning electron photomicrograph of the grains on edge is shown in FIG. 3.

EXAMPLE 13C

This example was prepared as described in Example 13A, except that the reaction vessel was 0.9 mM in adenine and 0.13 mole of $AgNO_3$ was used. The results are shown in Table III.

EXAMPLE 14

AgCl Ultrathin High-Aspect-Ratio Tabular Grain Emulsions Made Using Constant Flow Rate $AgNO_3$ Addition at 40° C. and 85° C.

EXAMPLE 14A

This emulsion was precipitated as described in Example 13A, except that the reaction vessel temperature was kept constant at 40° C., the pH was adjusted to 6.0, and 0.40 mole of $AgNO_3$ was added. The results are presented in Table III.

EXAMPLE 14B

This example was prepared as described in Example 13A, except that the reaction vessel temperature was kept constant at 85° C. The results are presented in Table III.

EXAMPLE 15

AgCl Ultrathin High Aspect Ratio Tabular Grain Emulsions Made Using Separate Nucleation, Ripening, and Growth Steps

EXAMPLE 15A

A stirred reaction vessel containing 400 mL of a solution which was 2% in bone gelatin, 1.4 mM in adenine, 0.04M in NaCl, and 0.20M in sodium acetate was adjusted to pH 6.2 with $HNO_3$ at 75° C. To this solution at 75° C. was added 4.0M $AgNO_3$ solution at 0.25 mL/min. Also, added as needed to maintain a constant pAg of 6.64 (0.04M in chloride), was a solution 4.0M in NaCl and 11.3 mM in adenine. After 2 min, the additions were stopped for 30 min to ripen the emulsion grains, then resumed by adding the $AgNO_3$ solution at 0.25 mL/min for 1 min and then the flow was accelerated to 5.0 mL/min over 30 min and finally held at this flow rate for 4 min. A total of 0.4 moles of Ag was added. The pAg was maintained at 6.64 by the double jet addition of the NaCl-adenine solution. When the pH reached 6.0, the additions were momentarily stopped and the reaction vessel contents were adjusted to 6.2 with NaOH. The results are summarized in Table III.

EXAMPLE 15B

To 400 mL of a stirred solution which was 2% in bone gelatin, 3.6 mM in adenine, 0.04M in NaCl, and 0.20M in sodium acetate, at pH 6.0 and at 40° C., was added 4.0M $AgNO_3$ solution at 5.0 mL/min. The pAg was maintained at 7.67 (0.04M in chloride) by the concurrent addition of a solution that was 4.0M in NaCl and 11.3 mM in adenine. After 1 min, the additions were stopped and the temperature was linearly increased from 40° C. to 60° C. requiring 12 min. After heating the contents of the reaction vessel for an additional 5 min at 60° C., 4M $AgNO_3$ solution was added at 0.25 mL/min for 1 min then linearly accelerated to 5.0 mL/min requiring 30 min and finally added at 5.0 mL/min for 4 min. A total of 0.4 moles of Ag was added. During the precipitation, the pAg was maintained at 7.05 (0.04M in chloride) by adding the NaCl-adenine solution. When the pH of the contents of the reaction vessel reached 5.8, the additions were momentarily stopped and the contents were adjusted to a pH of 6.0 with NaOH. The results are given in Table III.

EXAMPLE 15C

This emulsion was made similar to that of Example 15B, except a 4.0M NaCl solution was used to maintain the pAg until 0.13 moles of Ag had been added then a solution that was 4.0M in NaCl and 11.3M in adenine was used. The results are presented in Table III.

EXAMPLE 16

AgBrCl (10 mole % Br) Ultrathin High Aspect Ratio Tabular Grain Emulsions

EXAMPLE 16A

This emulsion was prepared similar to Example 12B, except that the salt solution used to maintain the constant pAg was 3.6M in NaCl, 0.4M in NaBr, and 16 mM in adenine. A total of 0.27 mole of $AgNO_3$ and 0.027 mole of NaBr were added. The results are summarized in Table III.

EXAMPLE 16B

This example was prepared similar to Example 12A, except that the salt solution used to maintain the constant pAg was 3.6M in NaCl, 0.4M in NaBr, and 16 mM in adenine. A total of 0.40 mole of $AgNO_3$ and 0.042 mole of NaBr were added. The results are summarized in Table III.

EXAMPLE 17

AgIBrCl (1 mole % I, 10 mole % Br) Ultrathin High-Aspect-Ratio Tabular Grain Emulsion This example was prepared similar to Example 12A, except that the salt solution used to maintain the constant pAg was 3.56M in NaCl, 0.4M in NaBr, 0.04M in NaI, and 16 mM in adenine. A total of 0.40 mole of $AgNO_3$, 0.0041 mole of NaI, and 0.041 mole of NaBr were added. The results are summarized in Table III.

TABLE III

| Example | $AgNO_3$ addition7 | Temp (°C.) | $AgNO_3$ added (mole) | Adenine in rxn vessel (mM) | Final adenine per Ag (mmole/mole) | Projected area as fine grain % | Maximum size of fine grains (μm) | Tabular Grain Population | | | |
|---|---|---|---|---|---|---|---|---|---|---|---|
| | | | | | | | | Mean ECD (μm) | Mean t (μm) | Mean Aspect ratio | % TGPA |
| 12A | a | 75 | 0.40 | 3.6 | 7.5 | 5 | 0.1 | 1.13 | 0.041 | 27.6 | 85 |

TABLE III-continued

| Example | $AgNO_3$ addition[7] | Temp (°C.) | $AgNO_3$ added (mole) | Adenine in rxn vessel (mM) | Final adenine per Ag (mmole/mole) | Projected area as fine grain % | Maximum size of fine grains (μm) | Tabular Grain Population: Mean ECD (μm) | Mean t (μm) | Mean Aspect ratio | % TGPA |
|---|---|---|---|---|---|---|---|---|---|---|---|
| 12B | a | 75 | 0.27 | 3.6 | 9.3 | 20 | 0.1 | 0.87 | 0.038 | 22.9 | 70 |
| 12C | a | 60 | 0.27 | 1.8 | 6.8 | 5 | 0.1 | 0.73 | 0.048 | 15.3 | 85 |
| 12D | a | 60 | 0.40 | 1.8 | 5.8 | 2 | 0.1 | 0.92 | 0.045 | 20.4 | 85 |
| 13A | c | 75 | 0.27 | 3.6 | 9.3 | 20 | 0.1 | 1.20 | 0.038 | 31.6 | 75 |
| 13B | c | 75 | 0.27 | 1.8 | 6.8 | 10 | 0.1 | 1.40 | 0.043 | 32.6 | 80 |
| 13C | c | 75 | 0.13 | 0.9 | 6.7 | 20 | 0.2 | 1.07 | 0.049 | 21.8 | 70 |
| 14A | c | 40 | 0.40 | 3.6 | 7.5 | 15 | 0.1 | 0.39 | 0.027 | 14.4 | 65 |
| 14B | c | 85 | 0.27 | 3.6 | 9.3 | 15 | 0.1 | 1.12 | 0.034 | 32.9 | 75 |
| 15A | r | 75 | 0.40 | 1.4 | 4.2 | 1 | 0.1 | 2.00 | 0.048 | 41.7 | 80 |
| 15B | r | 40/60 | 0.40 | 3.6 | 6.4 | 5 | 0.1 | 0.83 | 0.042 | 19.8 | 85 |
| 15C | r | 40/60 | 0.40 | 3.6 | 5.5 | 0 | — | 0.72 | 0.049 | 14.7 | 80 |
| 16A* | a | 75 | 0.27 | 3.6 | 9.3 | 20 | 0.1 | 0.87 | 0.028 | 31.0 | 70 |
| 16B* | a | 75 | 0.40 | 3.6 | 7.5 | 15 | 0.1 | 1.17 | 0.036 | 32.5 | 75 |
| 17** | a | 75 | 0.40 | 3.6 | 7.5 | 15 | 0.1 | 1.10 | 0.037 | 29.7 | 75 |

[7]a = accelerated flow rate; c = constant flow rate; r = ripening step
*10 mole percent bromide
**10 mole percent bromide, 1 mole percent iodide The invention has been described in detail with particular reference to preferred embodiments thereof, but it will be understood that variations and modifications can be effected within the spirit and scope of the invention.

What is claimed is:

1. A process of preparing a radiation sensitive high aspect ratio tabular grain emulsion, wherein tabular grains of less than 0.3 μm in thickness and an average aspect ratio of greater than 8:1 account for greater than 50 percent of the total grain projected area, said tabular grains containing at least 50 mole percent chloride, based on silver, comprising introducing silver ion into a gelatino-peptizer dispersing medium containing a stoichiometric excess of chloride ions with respect to the silver ions further characterized by a chloride ion concentration of less than 0.5 molar, a pH of from 4.6 to 9.0, and a grain growth modifier of the formula:

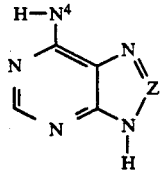

where $N^4$ is an amino moiety and

Z represents the atoms completing a 5 or 6 member ring.

2. A process according to claim 1 further characterized in that the concentration of chloride ion is less than 0.2 molar.

3. A process according to claim 1 further characterized in that the pH is in the range of from 5.0 to 8.

4. A process according to claim 1 further characterized in that $N^4$ represents a primary amino group.

5. A process according to claim 1 further characterized in that Z completes a six member ring.

6. A process according to claim 5 further characterized in that the six member ring is a diazine ring.

7. A process according to claim 1 further characterized in that Z completes a five member ring.

8. A process according to claim 7 further characterized in that the five member ring is an imidazolo or triazolo ring.

9. A process according to claim 1 further characterized in that the grain growth modifier satisfies the formula:

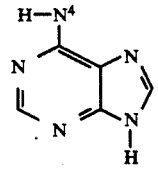

where $N^4$ is a primary or secondary amino group.

10. A process according to claim 9 further characterized in that the grain growth modifier is adenine.

11. A process according to claim 1 further characterized in that the grain growth modifier is selected from among adenine:

6-(N-methylamino)purine;

6-(N-ethylamino)purine;

6-(N-butylamino)purine;

4-amino-7,8-dihydropteridine;

8-azaadenine; and 6-benzylaminopurine.

12. A process according to claim 1 further characterized in that the grain growth modifier is present in at least $2\times10^{-4}$ molar concentration.

13. A process according to claim 1 further characterized in that the tabular grains contain less than 2 mole percent iodide, based on silver.

14. A process according to claim 1 further characterized in that the tabular grains consist essentially of silver chloride.

15. A process according to claim 1 further characterized in that during tabular grain growth following twinning at least one grain growth modifier is present selected from the group consisting of (a) iodide ions;

(b) thiocyanate ions;

(c) a compound of the formula:

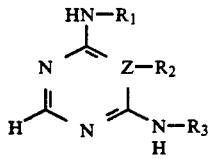

wherein Z is C or N; $R_1$, $R_2$ and $R_3$, which may be the same or different, are H or alkyl of 1 to 5 carbon atoms; when Z is C, $R_2$ and $R_3$ when taken together can be $—CR_4=CR_5—$ or $—CR_4=N—$, wherein $R_4$ and $R_5$, which may be the same or different are H or alkyl of 1 to 5 carbon atoms, with the proviso that when $R_2$ and $R_3$ taken together form the $—CR_4=N—$ linkage, $—CR_4=$ must be joined to Z;

(d) a compound of the formula:

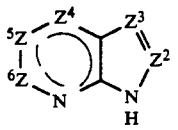

where $Z^2$ is $—C(R^2)=$ or $—N=$;

$Z^3$ is $—C(R^3)=$ or $—N=$;

$Z^4$ is $—C(R^4)=$ or $—N=$;

$Z^5$ is $—C(R^5)=$ or $—N=$;

$Z^6$ is $—C(R^6)=$ or $—N=$;

with the proviso that no more than one of $Z^4$, $Z^5$ and $Z^6$ is $—N=$;

$R^2$ is H, $NH_2$ or $CH_3$;

$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and $R^6$ is H or $NH_2$; and (e) a compound of the formula:

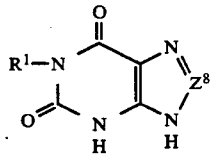

where $Z^8$ is $—C(R^8)=$ or $—N=$;

$R^8$ is H, $NH_2$ or $CH_3$; and $R^1$ is hydrogen or a hydrocarbon containing from 1 to 7 carbon atoms.

16. A process of preparing a radiation sensitive high aspect ratio tabular grain emulsion, wherein tabular grains of less than 0.2 μm in thickness and an average aspect ratio of greater than 8:1 account for greater than 70 percent of the total grain projected area, said tabular grains containing at least 50 mole percent chloride and less than 2 mole percent iodide, based on silver, comprising introducing silver ion into a gelatino-peptizer dispersing medium containing a stoichiometric excess of chloride ions with respect to the silver ions further characterized by a chloride ion concentration of less than 0.2 molar, a pH of from 5.0 to 8, and adenine in a concentration of from $7\times10^{-4}$ to 0.01 molar.

17. A process according to claim 16 further characterized in that adenine is present during grain growth following introduction of twin planes in the tabular grains.

* * * * *